United States Patent [19]

Wilmers et al.

[11] 4,250,721

[45] Feb. 17, 1981

[54] HEAT PUMP

[75] Inventors: Gottlieb Wilmers, Neuenstadt; Klaus Wissler, Kirchhausen, both of Fed. Rep. of Germany

[73] Assignee: Audi NSU Auto Union Aktiengesellschaft, Fed. Rep. of Germany

[21] Appl. No.: 57,450

[22] Filed: Jul. 13, 1979

[30] Foreign Application Priority Data

Aug. 3, 1978 [DE] Fed. Rep. of Germany ..... 2834075

[51] Int. Cl.[3] ..... F25B 1/10

[52] U.S. Cl. ..... 62/510

[58] Field of Search ..... 62/115, 116, 500, 503, 62/510

[56] References Cited

U.S. PATENT DOCUMENTS 2,513,361 7/1950 Rausch ..... 62/116

3,277,660 10/1966 Kemper et al. ..... 62/116

3,600,904 8/1971 Tilney ..... 62/503

FOREIGN PATENT DOCUMENTS 243492 12/1925 United Kingdom ..... 62/500

*Primary Examiner*—Lloyd L. King

*Attorney, Agent, or Firm*—Kane, Dalsimer, Kane, Sullivan and Kurucz

[57] ABSTRACT

A heat pump including a circuit for a fluid refrigerant, comprising a compressor V, a condenser 11, an expansion valve 13, an evaporator 14, and an injector pump 15 having a mixing chamber and diffuser in which the driving fluid for the pump is mixed with the refrigerant from the evaporator before returning to the compressor. This pressurized driving fluid is tapped off from the refrigerant circuit down the stream of the condenser and is passed through a heat exchanger 23 where it is fully evaporated. The heat input to this heat exchanger being obtained from the main refrigerant flow between the condenser and expansion valve.

8 Claims, 6 Drawing Figures

Figure 1:
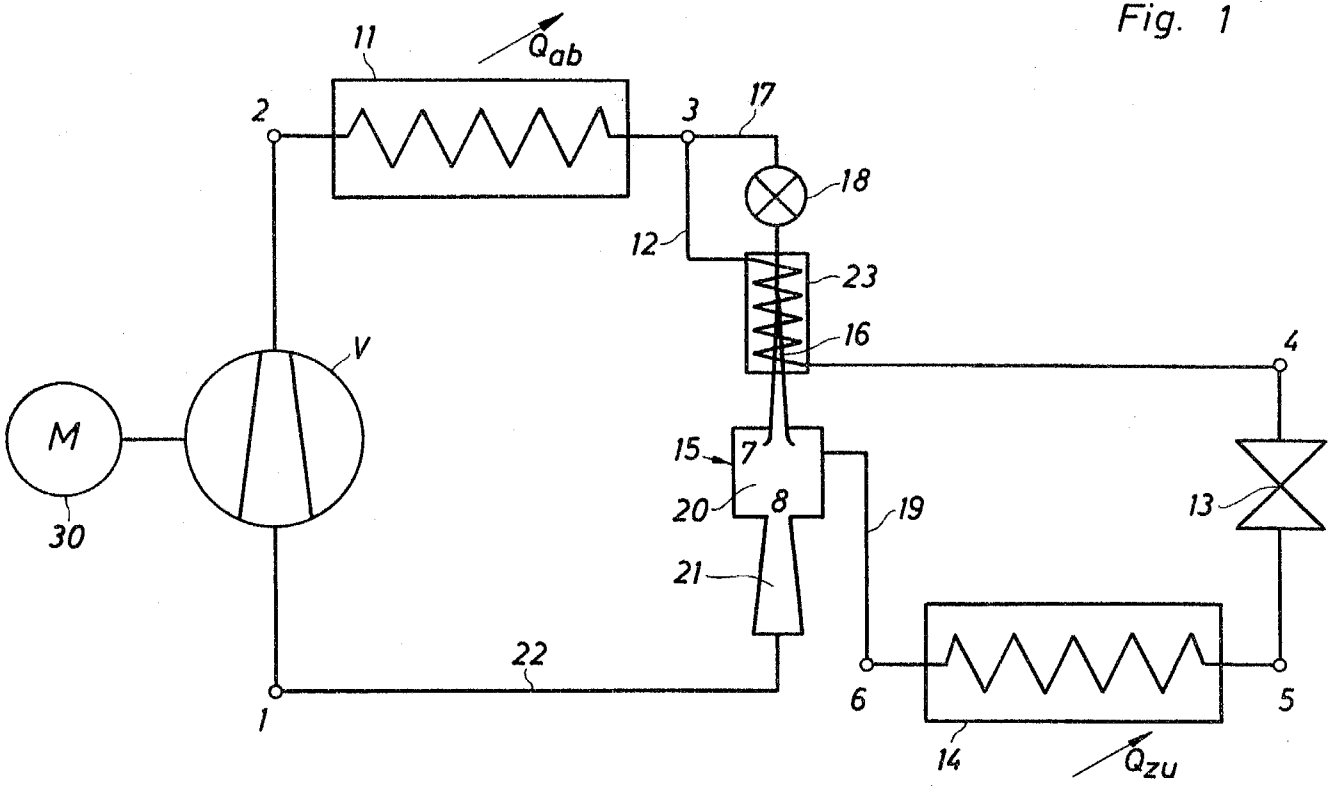

Qab
Qzu
M
V
1
2
3
4
5
6
7
8
11
12
13
14
15
16
17
18
19
20
21
22
23
30

V
2
1
22a
21a
20a
19a
10
15a
9
16a
6
$Q_{ab}$
11a
24
3
7
8
$Q_{zu}$
14a
17a
12a
4
5
23a
13a

HEAT PUMP

This invention relates to a compression heat pump having a refrigerant circuit comprising in series, a compressor, a condenser in which the refrigerant emits heat, an expansion valve, an evaporator in which the refrigerant absorbs heat, and an injector pump between the evaporator and the compressor, whose drive fluid is diverted from the refrigerant circuit downstream of the compressor.

Heat pumps of this type have recently been used for heating systems in which one part of the heating effect is provided by the refrigerant in the evaporator absorbing heat from the surroundings, i.e. from the air, water or the ground. A major problem in such heat pumps lies in the fact that with low outside temperatures the compressor work output per revolution of the shaft declines sharply, as not only the efficiency of the compressor but also the density of the agent drawn in declines with falling temperature. The necessary compressor output can then only be obtained by a corresponding increase in the driving speed of the compressor. Depending upon the size of the internal volume of the compressor, the driving speed at an outside temperature of, for example, −10° C., should be three to six times as high as at +5° C., although the necessary heating power may have increased only by a factor of 2 in relation to the point of comparison.

To keep the overall size of the compressor as small as possible, the latter is normally so designed that it produces the necessary power at, for example, 800 revs/min at a mean outside temperature of approximately +5° C. For compressors with standard clearance volumes, however, this means that an outside temperature of −10° C. a driving speed of up to 4000 r.p.m. is required, and at an outside temperature of −15° C. a speed of up to 9000 r.p.m. is necessary in order to produce the required compressor output. These large speed ranges cannot be obtained economically when the compressor is driven by means of an electromotor. If the compressor is driven by an internal combustion engine such speed ranges can in fact be obtained, but high fuel consumption, high wear and considerable noise have to be tolerated.

An object of the present invention is to provide a compression heat pump of the aforementioned type in which, with falling temperature, a smaller increase in the driving speed of the compressor is necessary than in known heat pumps in order to produce the necessary compressor output, but without the efficiency being seriously impaired.

Broadly stated the invention consists in a heat pump having a refrigerant circuit comprising in series, a compressor, a condenser in which the refrigerant emits heat, an expansion valve, and an evaporator in which the refrigerant absorbs heat, an injector pump between the evaporator and the compressor, whose drive fluid is diverted from the refrigerant circuit downstream of the compressor, the drive fluid conduit being tapped off from a point between the condenser and the expansion valve, and a heat exchanger for evaporating the drive fluid or the total refrigerant flow before entry into the compressor, the heat exchanger having a heat-absorbing side through which flows the drive fluid or the total refrigerant flow before passing to the injector pump, and a heat-emitting side through which flows the refrigerant before entry into the expansion valve.

In a preferred form of the invention, the intake pressure for the compressor, and therefore its efficiency and also the density of the fluid medium drawn in, is increased by switching on the injector pump, so that the driving speed of the compressor, when the outside temperature falls, has to be increased less than in known heat pumps which do not have an injector pump, in order to obtain the necessary compressor output.

The drive flow is diverted from the main flow downstream of the condensor, so that the heat content of the entire flow is available for heat emission to the heating medium in the condenser. By supplying heat to the drive flow or to the precompressed refrigerant, the refrigerant should be completely evaporated when entering the compressor to prevent liquid shocks.

The quantity of heat necessary for this is extracted from the refrigerant flow between the condenser outlet and the expansion valve (supercooling) and then supplied again from the surroundings, as the refrigerant passes into the evaporator with a correspondingly higher proportion of condensate. By comparison with a conventional compression heat pump, an improvement of efficiency is obtained by means of the invention, as the kinetic energy of the drive flow is not converted into heat in the expansion valve, but is made use of in the injector pump.

Using the heat extracted from the main flow, either the pre-compressed refrigerating agent which leaves the injector pump as "wet steam" (i.e. saturated), or the fluid drive flow to the pump can be evaporated. The latter can take place either in the injector pump itself, preferably by means of a specially constructed injector nozzle, or before entry into the pump, in which case a throttle should be incorporated between the condenser and the supplementary heat exchanger, so as to lower the temperature of the drive flow to such an extent that heat can be absorbed from the main refrigerant flow.

In the most simple case, the injector pump is not adjustable and it is automatically switched on by means of a valve in the drive flow conduit when the outside temperature falls below a preselected value. However, it may be desirable to arrange for the flow rate of the drive flow to be regulated. This can be achieved, for example, by means of an injector nozzle having a variable cross-section, and if necessary by a variable throttle in the drive flow conduit. As the output of the heat pump is normally controlled by varying the driving speed of the compressor in dependence upon the outside temperature, the quantity of drive flow can be varied in dependence upon the driving speed. Alternatively, control of the quantity of the drive flow, in a similar way to that of the throttle, can be made dependent on the compressor temperature, which it itself determined by the outside temperature. Here, the rate of drive flow can be increased when the outside temperature falls, which is desirable for high speed reduction. The maximum possible rate of drive flow varies with the surrounding temperature, as its ratio to the entire refrigerant flow rate must be kept within a range in which the energy which is necessary for the complete evaporation of the drive flow or of the entire main flow can be made available from the refrigerant flow before entry into the compressor. Thus, for example, in one particular case the proportion of the drive flow with an outside temperature of −15° C. must be 40% of the entire flow, whilst at an outside temperature of +15° C., it can be no higher than 5–10%.

Figure 2:
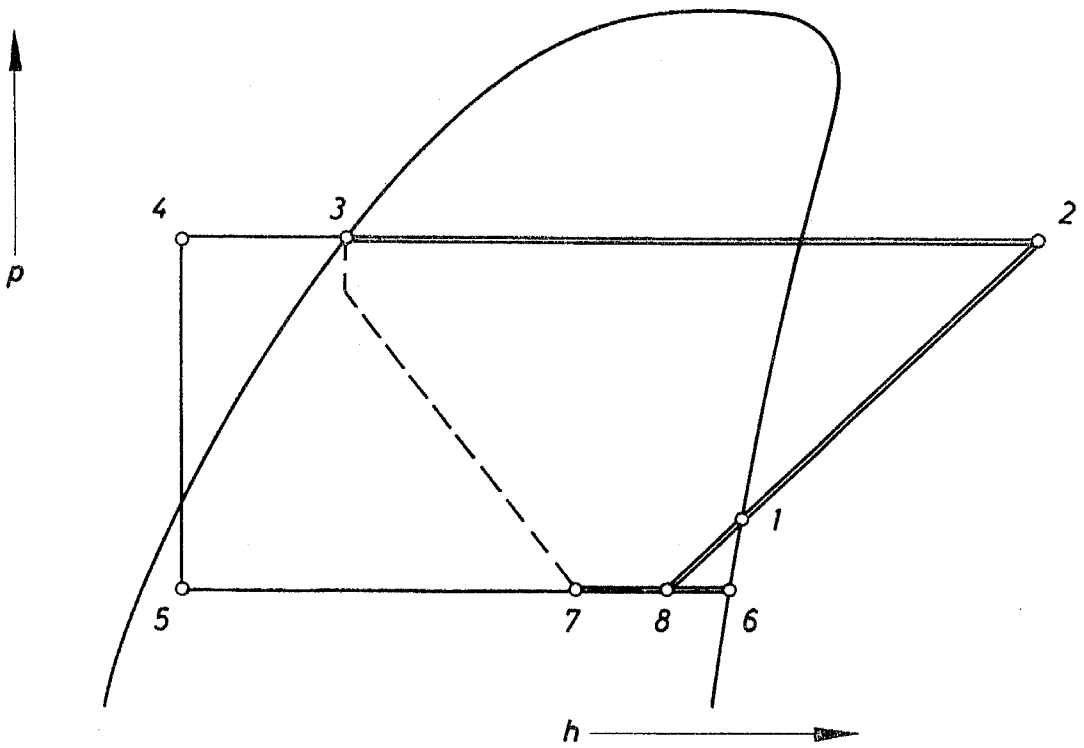
Figure 3:
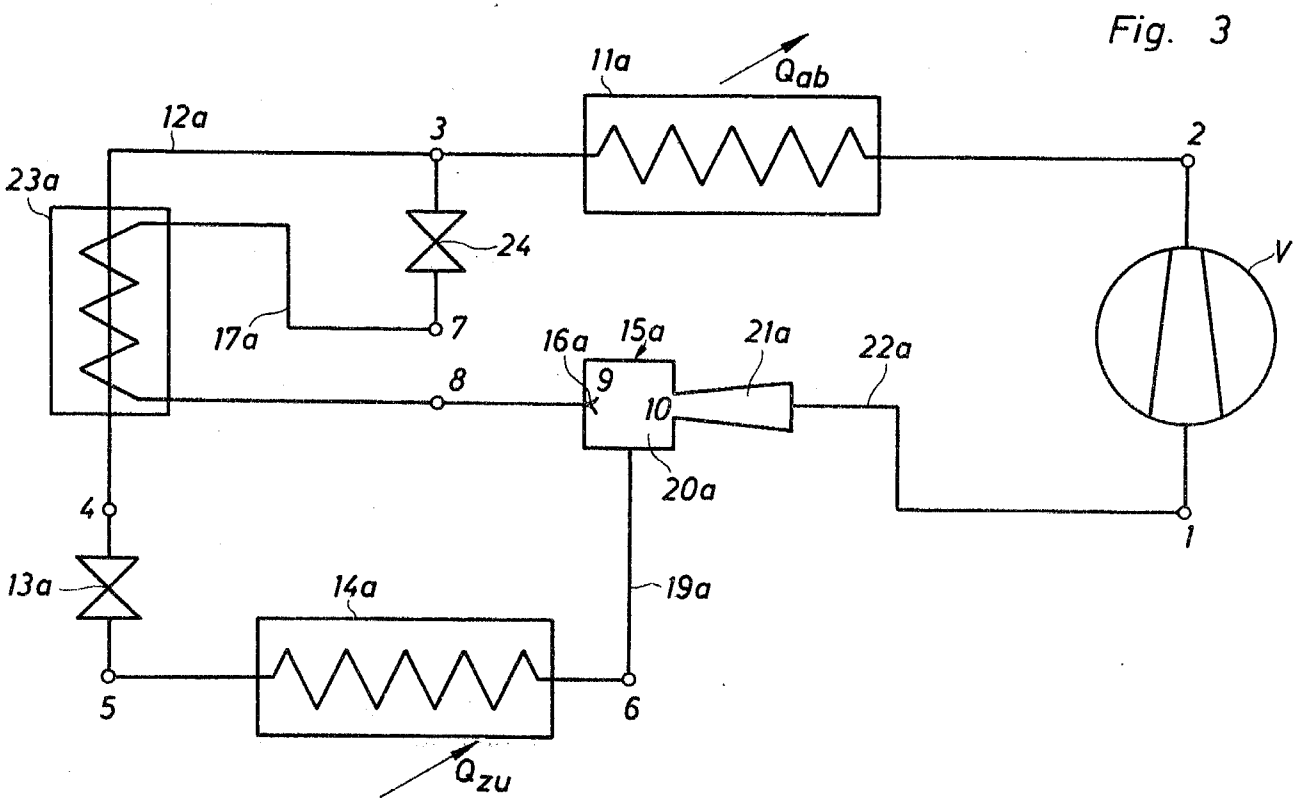
Figure 4:
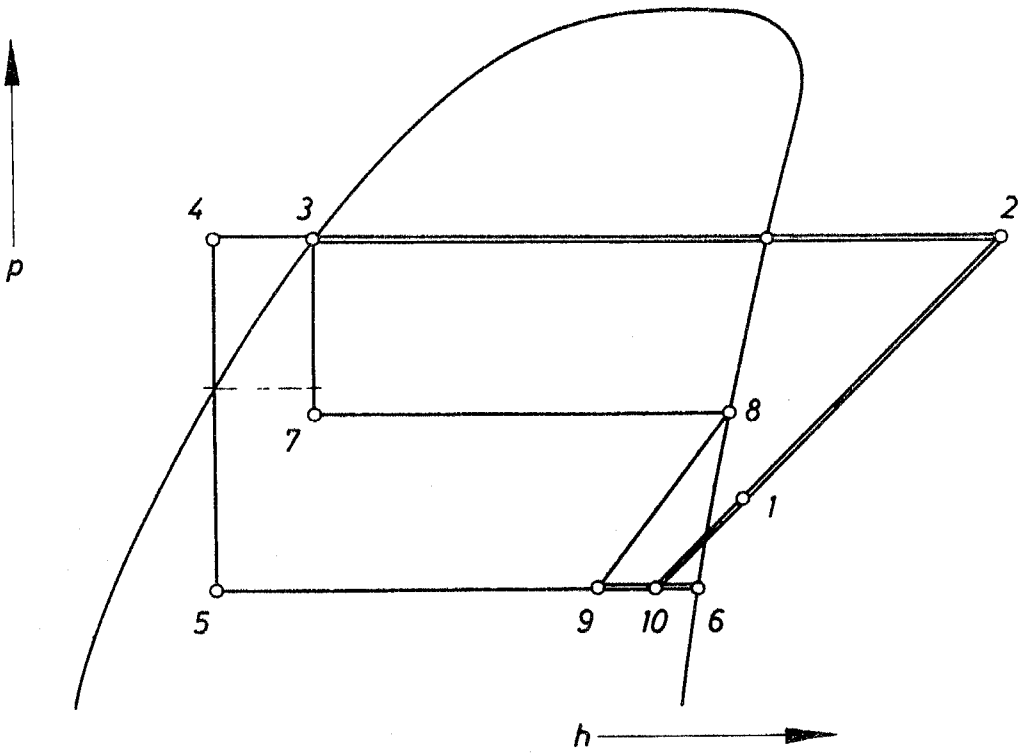
Figure 5:
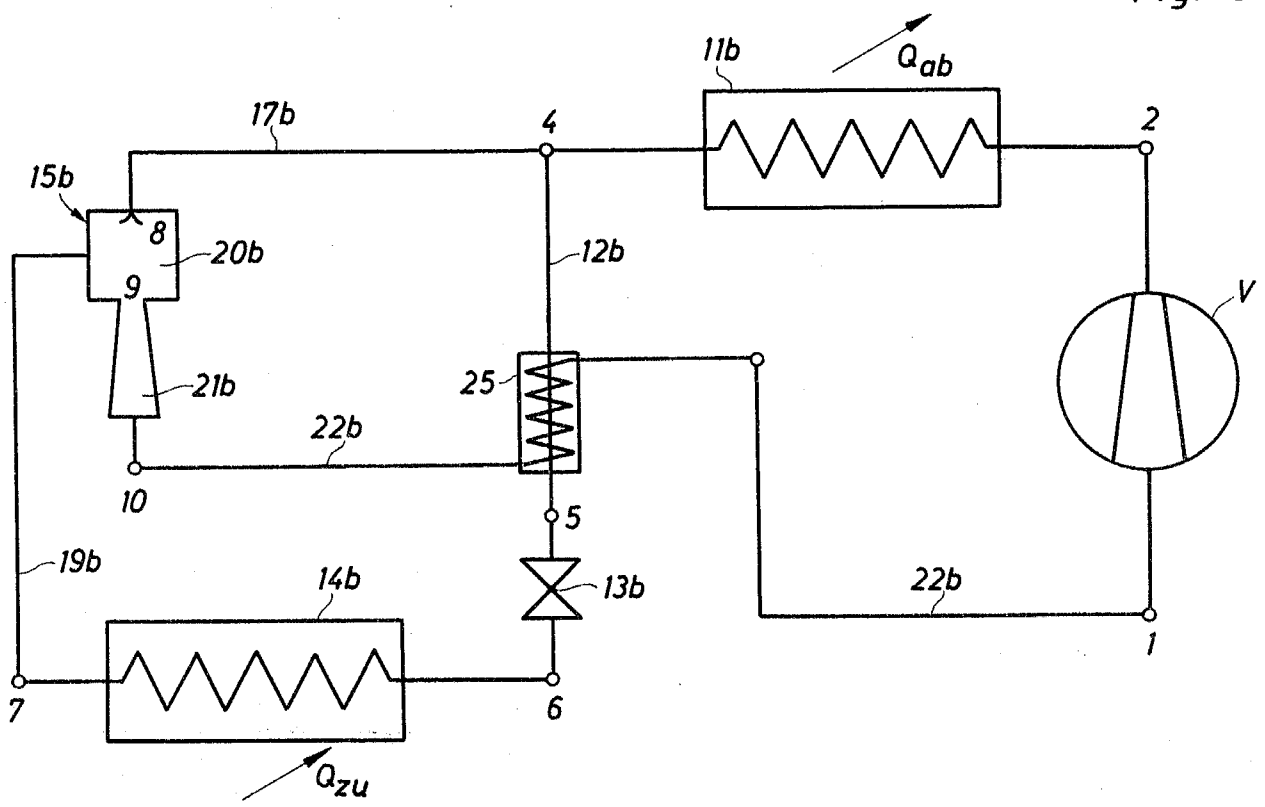
Figure 6:
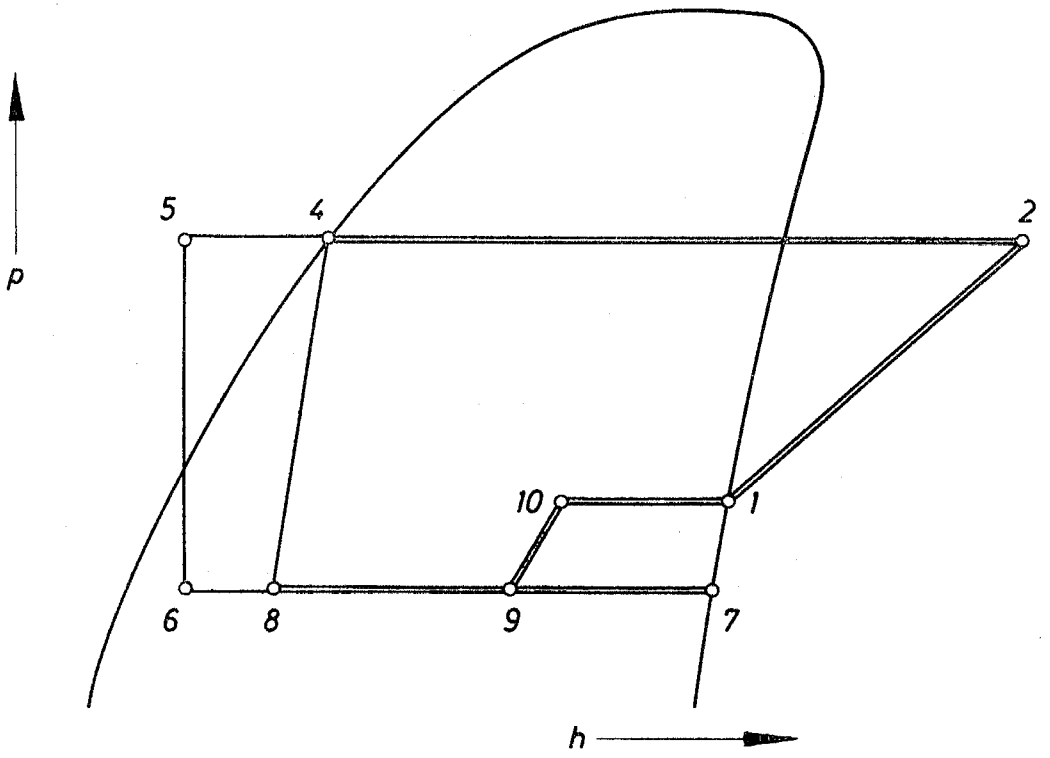

The invention may be performed in various ways and the specific embodiments will now be described by way of example with reference to the accompanying drawings, in which:

FIG.1 is a circuit diagram of a compression heat pump in the first embodiment of the invention, FIG. 2 is a p-h (pressure-enthalpy) diagram illustrating the operation of the heat pump shown in FIG. 1, FIG. 3 is a circuit diagram of the second embodiment of the invention, FIG. 4 is a p-h diagram for the compression heat pump illustrated in FIG. 3, FIG. 5 is a circuit diagram of the third embodiment of the invention, and FIG. 6 is a p-h diagram for the compression heat pump of FIG. 5.

In the first embodiment, as shown in the circuit diagram of FIG. 1, a compressor V supplies the refrigerant in the vapour state to a condenser 11, in which heat is emitted from the refrigerant to a heating medium of a heating circuit which is not illustrated. The refrigerant leaves the condenser 11 in a liquefied state and the major part passes through a conduit 12 to an expansion valve 13, in which the temperature of the refrigerant is reduced below the temperature of the surroundings from which heat is to be absorbed. The absorption of heat from the surroundings, for example, from the air, from underground water or other water, or from the ground, takes place in the evaporator 14, in which the refrigerant is converted back into the vapour state by heat absorption. In normal heat pump operations, the refrigerant, which is now in the vapour state, passes back to the suction side of the compressor 10.

In order to increase the efficiency at low temperatures of the compressor V and the density of the refrigerant drawn in by the latter, an injector pump 15 is located between the evaporator 14 and the compressor V. The injector nozzle 16 of this injector pump 15 is connected through a conduit 17 to the pipeline 12 downstream of the condenser 11. A stop valve 18 may be located in the drive flow conduit 17, so arranged that the injector pump 15 is switched on only below a selected outside temperature. The evaporator 14 is connected by a duct 19 to the mixing chamber 20 of the injector pump 15, and the diffuser 21 of the jet pump 15 is connected via a duct 22 to the suction side of the compressor V.

The drive flow which is diverted from the conduit 12 is composed of liquefied refrigerant, which has to be completely evaporated when entering the mixing chamber 20; for this purpose, the drive nozzle 16 of the pump 15 is designed as a heating nozzle including a heat exchanger 23. Since the drive flow, because of expansion in the nozzle 16, is at a lower pressure and temperature level than the main flow current flowing through the conduit 12, the latter can emit heat to the drive flow in the heat exchanger 23, so that the drive flow consists of completely evaporated refrigerant. As the refrigerant current which is supplied through the duct 19 from the evaporator 14 is also in the vapour state, this ensures that the compressor V sucks in only refrigerant in the vapour state.

The mode of operation of the heat pump of FIG. 1 can be seen from FIG. 2, in which the numbered points correspond to the states at the places marked in the circuit diagram of FIG. 1. It can be seen that the compressor V performs compression of the refrigerant from Point 1 to Point 2, whilst the injector pump performs compression from the evaporator Point 6 to the compressor inlet pressure Point 1. State 8 is established in the mixing chamber 20 of the injector pump 15, and then compression to State 1 takes place in the diffuser 21.

In the embodiment of FIGS. 3 and 4, parts identical or similar to those in the first embodiment are marked with the same reference numbers, but with the index a. The main difference is that the drive 1ozzle 16*a* of the injector pump 15*a* is not a heating nozzle. Instead, there is located in the drive flow conduit 17*a* a special heat exchanger 23*a*, which is connected into the main flow duct 12*a*. Furthermore, a throttle 24 is located in the drive flow conduit 17*a*, upstream of the heat exchanger 23*a*. In the embodiment of FIG. 1, difficulties can arise because the drive nozzle 16 has contradictory demands to fulfil, namely to minimise friction as far as possible in order to keep losses low, on the one hand, and yet to have as large as possible a surface in order to obtain good heat transmission, on the other hand.

In the second embodiment however these problems are largely avoided. The p-h diagram shows once again the states at Points 1 to 10 in the circuit diagram of FIG. 3. The compressor V compresses from Point 1 to Point 2. In the condenser 11*a* heat is emitted by the total main refrigerant flow, so that State 3 is established at the end of the condenser 11*a*. The drive flow is now diverted from the main current, whereby reduction of pressure at Point 7 occurs through the throttle 24. The fluid refrigerant is evaporated in the heat exchanger 23*a*, so that after flowing through the heat exchanger 23*a*, State 8 is produced.

In the injector pump 15*a*, pressure and enthalpy of the drive flow are reduced to State 9. The current flowing through the duct 12*a* emits heat from Point 3 to Point 4 in the heat exchanger 23*a*. In the expansion valve 13*a* the pressure of the current is reduced from Point 4 to Point 5. In the evaporator 14*a* the current absorbs heat from the surroundings and passes again into the vapour state at Point 6. In the mixing chamber 20*a* of the pump 15*a* State 10 is established by the mixing of the drive flow and main refrigerant, and the pressure of the entire flow current is finally brought back to State 1 in the diffuser 21*a*.

In the third embodiment of FIG. 5, once again the same reference numbers as in FIG. 1, but marked with the index b, are used for identical or similar parts. In this embodiment, instead of the heat exchangers 23 or 23*a* for evaporating the drive flow, a heat exchanger 25 for drying the pre-compressed refrigerant is located between the pump 15*b* and the compressor V. Once again the main refrigerant current flows through the heat-emitting side of the heat exchanger between the condenser 11*b* and the expansion valve 13*b*.

The mode of operation of the heat pump of FIG. 5 can be seen from FIG. 6. The compressor V compresses the refrigerant from Point 1 to Point 2. In the condenser 11*b* heat emission occurs from the total refrigerant current to the heating medium (not shown), whereby the refrigerant is liquefied and State 4 is reached. The drive flow to the injector pump 15*b*, is then diverted and flows through the duct 17*b*, and expands to State 8 in the drive nozzle. The current flowing through the duct 12*b* emits heat in the heat exchanger 25, whereby its heat content decreases from Point 4 to Point 5. The pressure and also the temperature of the current is reduced to State 6 by the expansion valve 13*b*. In the evaporator 14*b* the current absorbs heat from the surroundings, whereby the refrigerant is brought back to the vapour state, and State 7 is reached. Mixing of the main flow current with the drive flow takes place in the mixing chamber 20*b* of the pump 15*b*, whereby State 9 is reached. Pressure is then increased to State 10 in the diffuser 21*b*. The entire flow current now flows through the heat exchanger 25, whereby the total flow is converted into the vapour state and can enter the compressor V at State 1.

In the embodiment of FIG. 5 also, a stop valve corresponding to the valve 18 in FIG. 1 can be located in the drive flow duct 17*b*.

In all the embodiments illustrated the compressor V is preferably driven by an internal combustion engine 30, which is indicated in FIG. 1 and whose speed is controlled in dependence upon the heating requirement.

We claim:

1. A heat pump having a refrigerant circuit comprising in series, a compressor, a condenser in which the refrigerant emits heat, an expansion valve, and an evaporator in which the refrigerant absorbs heat, an injector pump between the evaporator and the compressor, whose drive fluid is diverted from the refrigerant circuit downstream of the compressor, the drive fluid conduit being tapped off from a point between the condenser and the expansion valve, and a heat exchanger for evaporating the drive fluid or the total refrigerant flow before entry into the compressor, the heat exchanger having a heat-absorbing side through which flows the drive fluid or the total refrigerant flow, and a heat-emitting side through which flows the refrigerant before entry into the expansion valve.

2. A heat pump as claimed in claim 1, in which the injector pump has a drive nozzle which also acts as a heat exchanger.

3. A heat pump as claimed in claim 1, including a throttle upstream of the heat exchanger, the throttle and heat exchanger being located in the drive fluid conduit between the condenser and the injector pump.

4. A heat pump as claimed in any one of claims 1 to 3, including a stop valve located in the drive fluid conduit.

5. A heat pump as claimed in claim 1, in which the injection pump has a drive nozzle, and the cross-section of the drive nozzle of the injector pump can be varied in order to regulate the flow rate of the drive fluid.

6. A heat pump as claimed in claim 5, in which a control valve, whose cross-section can be varied in accordance with the cross-section of the drive nozzle, located in the drive fluid conduit.

7. A heat pump as claimed in claim 5, wherein the expansion valve can be adjusted in dependence upon the outside temperature, and the cross-section of the drive nozzle of the injector pump can be varied in accordance with the expansion valve.

8. A heat pump as claimed in claim 5, in which the cross-section of the drive nozzle of the injector pump can be varied in such a way that the proportion of the drive fluid increases when the outside temperature falls.

* * * * *